US006206051B1

(12) United States Patent
Arie

(10) Patent No.: US 6,206,051 B1
(45) Date of Patent: Mar. 27, 2001

(54) NON REED INTERFERING SUCTION WEFT REMOVAL

(75) Inventor: Kiyoshi Arie, Kanazawa (JP)

(73) Assignee: Tsudakoma Kogyo Kabushiki Kaisha, Ishikawa-Ken (JP)

( * ) Notice: Subject to any disclaimer, the term of this patent is extended or adjusted under 35 U.S.C. 154(b) by 0 days.

(21) Appl. No.: 09/573,256

(22) Filed: May 18, 2000

(30) Foreign Application Priority Data

May 19, 1999 (JP) ..... 11-138068

(51) Int. Cl.[7] ..... D03D 47/38; D03D 51/34

(52) U.S. Cl. ..... 139/194; 139/302; 139/370.2; 139/430

(58) Field of Search ..... 139/194, 302, 139/430, 116.1

(56) References Cited

U.S. PATENT DOCUMENTS

| | | | | |
|---|---|---|---|---|
| 3,744,533 | * | 7/1973 | Yano et al. | 139/430 |
| 4,498,504 | * | 2/1985 | Allen et al. | 139/430 |
| 4,549,582 | * | 10/1985 | Kung et al. | 139/430 |
| 4,607,667 | * | 8/1986 | Gibson | 139/302 |
| 5,224,521 | * | 7/1993 | De Jagger | 139/194 |
| 5,226,453 | * | 7/1993 | Bamelis | 139/194 |
| 5,735,316 | | 4/1998 | Hehle . | |
| 6,076,563 | * | 6/2000 | Wahhoud et al. | 139/194 |
| 6,082,413 | * | 7/2000 | Scori et al. | 139/194 |

FOREIGN PATENT DOCUMENTS 9-291438 11/1997 (JP) .

* cited by examiner

*Primary Examiner*—Andy Falik
(74) *Attorney, Agent, or Firm*—Wenderoth, Lind & Ponack, L.L.P.

(57) ABSTRACT

A weft yarn end removing mechanism is incorporated into a shuttleless loom that holds leading end part of a picked weft yarn under tension by a weft yarn tightening device and beats up the weft yarn into the cloth fell of a fabric on the shuttleless loom by a reed. The weft yarn end removing mechanism includes a weft yarn sucking device for holding the leading end part of the weft yarn beaten up into the cloth fell, and a weft yarn cutting device for cutting the leading end part of the weft yarn extending between the selvage of the fabric and the weft yarn sucking device. The leading end part of the picked weft yarn being shifted toward the cloth fell is sucked through a first suction opening into the weft yarn sucking device and then the leading end part moves from the first suction opening to a second suction opening of the weft yarn sucking device. The weft yarn cutting device cuts the leading end part extending between the selvage of the fabric and the second suction opening of the weft yarn sucking device.

3 Claims, 3 Drawing Sheets

NON REED INTERFERING SUCTION WEFT REMOVAL

BACKGROUND OF THE INVENTION

1. Field of the Invention

The present invention relates to a method of removing a leading end part of a weft yarn picked on a shuttleless loom, such as a fluid jet loom, and a weft yarn end removing mechanism for removing a leading end part of a picked weft yarn.

2. Description of the Related Art

Referring to FIG. 1, a leading end part of a weft yarn 3 picked on a shuttleless loom 1 is caught by catch cords 4 to hold the picked weft yarn 3 tight, and the picked weft yarn 3 is beaten up with a reed 6. Subsequently, the leading end part of the weft yarn 3 extending between a selvage of a fabric 5 on an arriving side opposite a picking side and the catch cords 4 is cut off by a cutting device 7. Portions of the catch cords 4 used for catching leading end parts of picked weft yarns 3 are disposed of together with the cut leading end parts of the picked weft yarns 3. Thus, the catch cords 4 are not used for constructing the fabric 5, but are used only for weaving the fabric 5 and consumed wastefully.

FIG. 2 shows a weft yarn end removing mechanism previously proposed to avoid the wasteful consumption of yarns that do not contribute to constructing the fabric 5, such as the catch cords 4. This weft yarn end removing mechanism catches a leading end part of a picked weft yarn 3 by a tightening nozzle 8 to hold the picked weft yarn 3 tight, transfers the leading end part from the tightening nozzle 8 to a suction device 9, and cuts the leading end part of the weft yarn 3 off the picked weft yarn 3 at a position between the selvage of the fabric 5 and the suction device 9 by a cutting device 10 as shown in FIG. 2. The function of the catch cords 4 is replaced with the cooperative operation of the tightening nozzle 8 and the suction device 9.

When the weft yarn end removing mechanism shown in FIG. 2 is used, one end of the reed 6 on the side of the suction device 9 must be spaced from the suction device 9 so that the reed 6 may not strike against the suction device 9 during a beat-up operation. Consequently, reeds of different lengths must be prepared for weaving fabrics of different widths, respectively.

SUMMARY OF THE INVENTION

Accordingly, it is an object of the present invention to provide a method of removing a weft yarn end capable of removing a leading end part of a picked weft yarn without using any catch cords and without placing any restrictions on the length of a reed.

Another object of the present invention is to provide a weft yarn end removing mechanism for carrying out the method of removing a weft yarn end.

The present invention is intended to be applied to a shuttleless loom that holds a leading end part of a picked weft yarn by a weft yarn tightening device disposed on an arriving side opposite a picking side, and beats up the tight picked weft yarn into the cloth fell of a fabric by a reed.

The shuttleless loom has a weft yarn sucking device and a weft yarn cutting device. The weft yarn sucking device is disposed nearer to a take-up with respect to the cloth fell to hold a leading end part of a weft yarn picked and beaten up into the cloth fell. The weft yarn cutting device is disposed nearer to the take-up with respect to the cloth fell, and cuts a leading end part of the picked and beaten up weft yarn projecting from the selvage of the fabric on the arriving side in a cutting region between the selvage of the fabric and the weft yarn sucking device.

According to a first aspect of the present invention, a method of removing a weft yarn end includes the steps of: sucking a leading end part of a picked weft yarn being shifted toward a cloth fell of a fabric by a beat-up motion into a weft yarn sucking device through a first suction opening of the weft yarn sucking device, lying on a path of the picked weft yarn and extending (i.e. opening and facing) in a picking direction; holding the leading end part of the weft yarn beaten up into the cloth fell in a second suction opening of the weft yarn sucking device, continuous with the first suction opening, lying opposite to a selvage of the fabric and extending (i.e. opening or facing) in a take-up direction; and cutting the leading end part of the weft yarn extending between the selvage of the fabric and the second suction opening off the weft yarn beaten up into the cloth fell.

According to a second aspect of the present invention, a weft yarn end removing mechanism includes a weft yarn sucking device having a first suction opening and a second suction opening. The first suction opening lies on a path of the picked weft yarn and extends in a picking direction. A leading end part of a picked weft yarn being shifted toward a cloth fell of a fabric by a beat-up motion is sucked through the first suction opening into the weft yarn sucking device. The second suction opening is continuous with the first suction opening, lies opposite to a selvage of the fabric, extends in a take-up direction and holds the leading end part of the weft yarn beaten up into the cloth fell.

The leading end part of the picked weft yarn arrived at the arriving side is held and is kept in a tight state by a weft yarn tightening device fastened to a slay. The weft yarn thus held by the weft yarn tightening device is shifted toward the cloth fell by a beat-up motion. Upon the arrival of the weft yarn at a position near the cloth fell, the leading end part of the weft yarn is sucked through the first suction opening into the weft yarn sucking device. The leading end part of the weft yarn sucked through the first suction opening into the weft yarn sucking device is transferred to and held in the second suction opening as the beat-up motion proceeds. At this stage, the leading end part of the weft is inclined in the take-up direction with respect to the picking direction. The cutting device cuts successively the leading end parts of successively picked weft yarns that enter a cutting region successively. The leading end part cut off the weft yarn woven into the fabric is delivered by the weft yarn sucking device to a dust box by air currents.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
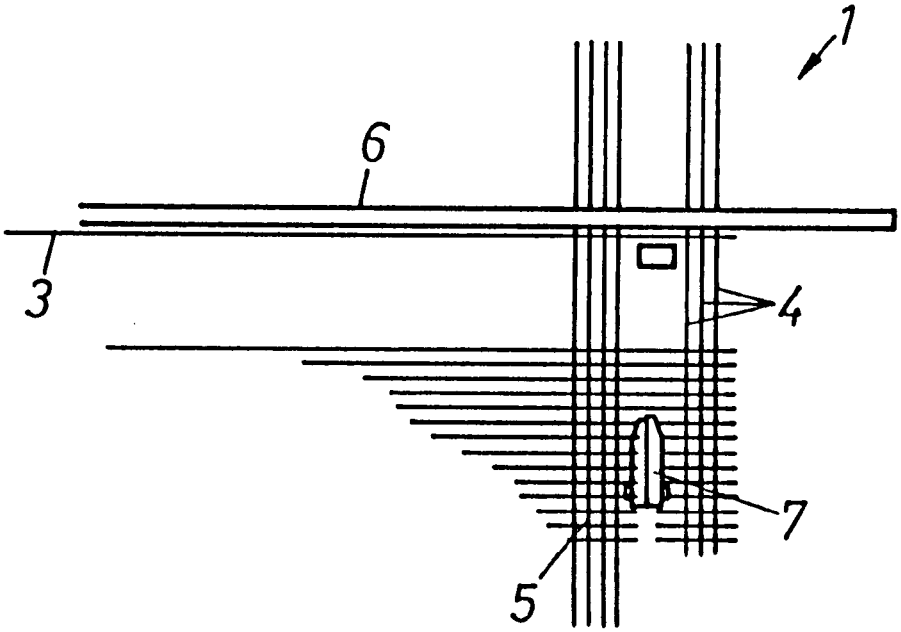
FIG.1 PRIOR ART
FIG. 1 is schematic plan view of a conventional weft yarn end removing mechanism.
Figure 2:
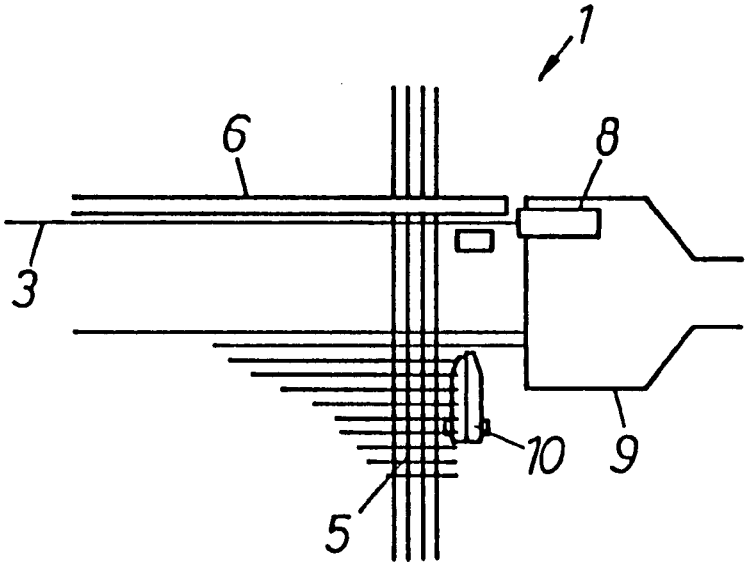
FIG.2 PRIOR ART
FIG. 2 is a schematic plan view of another conventional weft yarn end removing mechanism.
Figure 3:
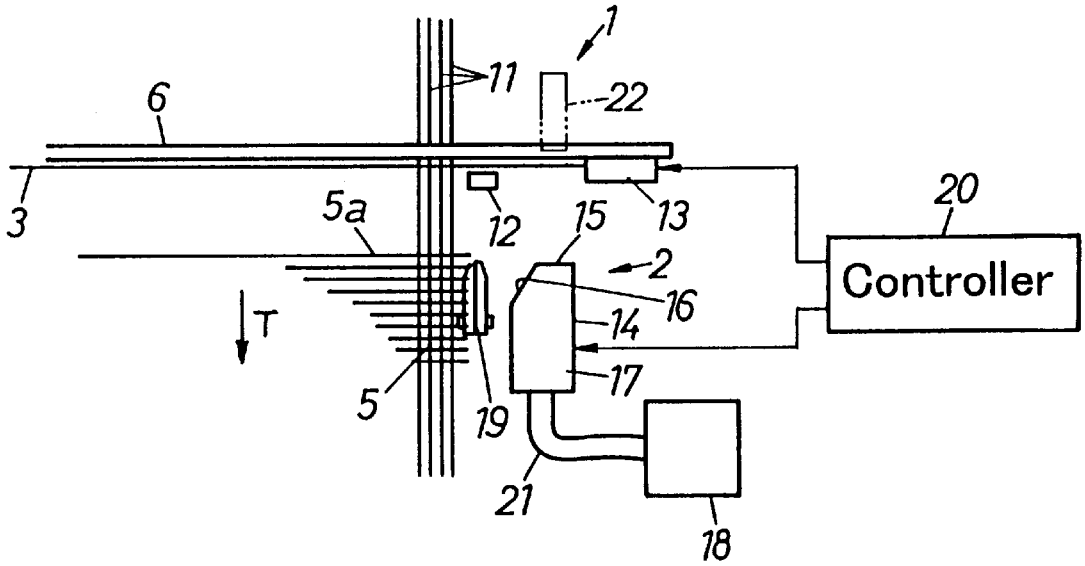
FIG. 3 is a schematic plan view of a weft yarn end removing mechanism in a preferred embodiment according to the present invention.

Referring to FIG. 3 showing a weft yarn end removing mechanism 2 in a preferred embodiment according to the present invention incorporated into a shuttleless loom 1, the shuttleless loom inserts a weft yarn 3 in a shed formed by selectively raising and lowering warp yarns 11 by a picking device, not shown, disposed on the picking side opposite the arriving side so that a leading end part of the weft yarn 3 extends on the arriving side. The insertion of the weft yarn 3 is detected by a weft yarn detector 12 fixed to a part of a reed 6 at a position on the side of the arriving side. The leading end part of the weft yarn 3 is caught and held in a predetermined tight state by a weft yarn tightening device 13, such as a stretching suction nozzle. The reed 6 moves toward a cloth fell 5*a* in a fabric 5 for a beat-up motion. The weft yarn 3 held by the weft tightening device 13 is shifted toward the cloth fell 5*a* and is beaten into the cloth fell 5*a* of the fabric 5.

The weft yarn end removing mechanism 2 includes a weft yarn sucking device 14. The weft yarn sucking device 14 has a tubular body 17 disposed nearer to a take-up with respect to the cloth fell 5*a*. The tubular body 17 has a first suction opening 15 and a second suction opening 16. The weft yarn sucking device 14 is connected by a hose 21 to a dust box 18. Air is sucked through the weft yarn sucking device 14 by a blower, not shown, connected to the dust box 18 or by the agency of a negative pressure produced by a jet of air.

A weft yarn cutting device 19 disposed at a position between a selvage of the fabric 5 and the weft yarn sucking device 14 and nearer to the take-up with respect to the cloth fell 5*a*. The weft yarn cutting device is driven by a mechanical or electrical driving device. The weft yarn cutting device is driven for a yarn cutting operation once every picking cycle or once every several picking cycles.

During a weaving operation, a weft yarn 3 is picked by a picking operation and a leading end part of the picked weft yarn 3 reaches the arriving side. The leading end part of the weft yarn 3 is sucked by the weft yarn tightening device 13, such as a stretching nozzle, and is held under a predetermined tension. Then, the weft yarn 3 thus held in the shed is beaten into the cloth fell 5*a* by the beat-up motion of the reed 6. When the leading end part of the weft yarn 3 approaches the first suction opening of the weft yarn sucking device 14, the sucking operation of the weft yarn tightening device 13 is stopped to suck the leading end part of the weft yarn 3 through the first suction opening 15 into the weft yarn sucking device 14. When necessary, a supplementary nozzle 22 is held on a member combined with the reed 6, such as a reed holder of a reed frame, to blow air toward the first suction opening 15 from behind the dents of the reed 6. Air is jetted through the nozzle 22 when the weft yarn sucking device 14 executes a weft yarn end sucking operation to assist the weft yarn sucking device to suck in the leading end part of the weft yarn 3.

Figure 4:
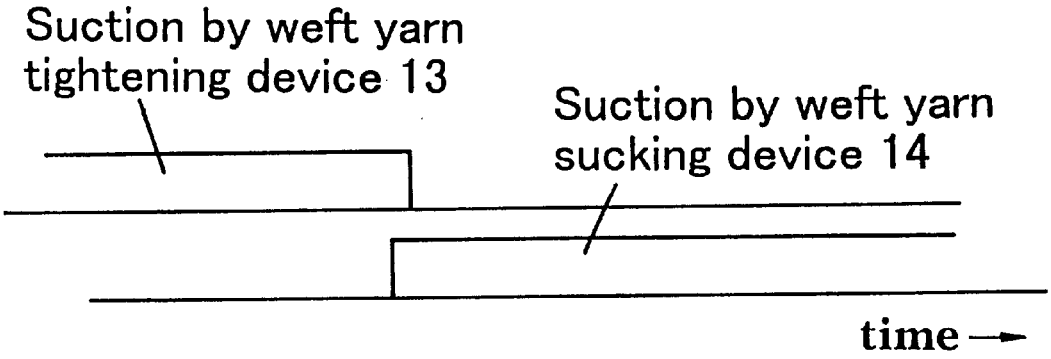
FIG. 4 is a diagrammatic view for assistance in explaining the operations of a weft yarn tightening device and a weft yarn sucking device.

As shown in FIG. 4, the respective operating periods of the weft yarn tightening device 13 and the weft yarn sucking device 14 overlap each other; that is, the weft yarn sucking device 14 starts its sucking operation before the weft yarn tightening device 13 stops its weft yarn tightening operation. The sucking operation of the weft yarn sucking device 14 may be either continuous or intermittent. The weft yarn tightening device 13 and the weft yarn sucking device 14 are controlled by a controller 20 so that the weft yarn tightening device 13 and the weft yarn sucking device 14 operate in synchronism with principal motions of the shuttleless loom 1. The supplementary nozzle 22, as well as the weft yarn sucking device 14, are controlled by the controller 20.

The leading end part of the weft yarn 3 thus beaten into the cloth fell 5*a* extends between the selvage of the fabric 5 and the weft yarn sucking device 14. As the weaving operation proceeds, the leading end part of the weft yarn 3 moves toward the take-up together with the fabric 5. Consequently, the leading end part shifts from the first suction opening 15 into the second suction opening 16, and inclines in the take-up direction T with respect to the picking direction. When the leading end part of the weft yarn 3 enters a cutting region in which the weft yarn cutting device 19 cuts the weft yarn 3, the weft yarn cutting device 19 cuts the leading end part off the weft yarn 3 woven into the fabric 5. The leading end part thus cut off is sucked through the weft yarn sucking device 14 and the hose 21 into the dust box 8.

Figure 5:
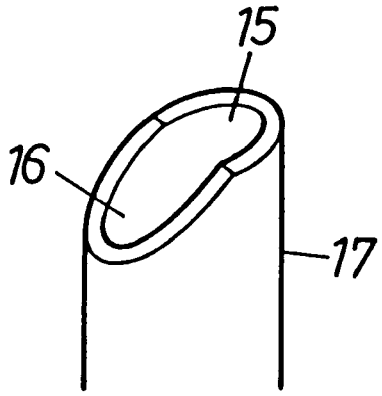
FIG. 5 is a fragmentary perspective view of an essential component of the weft yarn sucking device.
Figure 6:
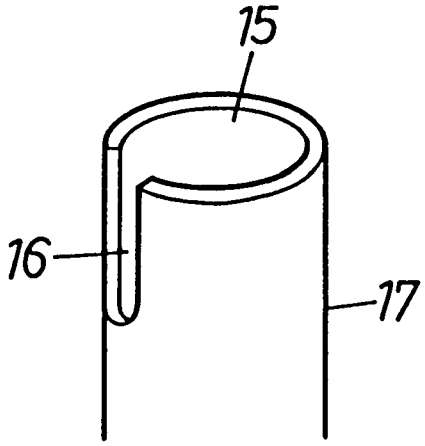
FIG. 6 is a fragmentary perspective view of another essential component of the weft yarn sucking device.

FIGS. 5 and 6 show examples of the tubular body 17 of the weft yarn sucking device 14. When forming a tubular body 17 shown in FIG. 4, an end part of a cylindrical member is beveled and the beveled end part is cut perpendicularly to the axis of the cylindrical member to form a first suction opening 15 and a second suction opening 16. When forming a tubular body 17 shown in FIG. 5, an end part of a cylindrical member is cut perpendicularly to the axis of the cylindrical member and a slit is formed in the end part of the cylindrical member to form a first suction opening 15 and a second suction opening 16.

While the leading end part of the weft yarn 3 is extended between the selvage of the fabric and the weft yarn sucking device 14, the tension of the weft yarn 3 is dependent on the pulling action of air currents and the tension is comparatively unstable. The tension of the weft yarn 3 in this state can be stabilized and can be prevented from falling off the weft yarn sucking device 14 by twisting the leading end parts of two or three picked weft yarns 3 and sucking the twisted leading end parts of the weft yarns 3 collectively into the weft yarn sucking device 14. The leading end parts of two or three picked weft yarns 3 can be twisted by a rotary brush or a rotary hook incorporated into the weft yarn sucking device 14 or by generating whirling air currents in the tubular body 17 of the weft yarn sucking device 14.

As is apparent from the foregoing description, according to the present invention, the weft yarn sucking device does not interfere with the reed in a beat-up motion because the weft yarn sucking device is disposed nearer to the take-up with respect to the cloth fell. Since the first suction opening of the weft yarn sucking device opens in the beat-up direction in which the reed moves in its beat-up motion and part of the second suction opening of the same lies near the cloth fell, the leading end part of the picked weft yarn being moved into the cloth fell can be surely sucked into the weft yarn sucking device at a position near the cloth fell. Since the weft yarn cutting device can be disposed so that the weft yarn cutting device may not interfere with the reed in a beat-up motion at a position nearer to the take-up with respect to the cloth fell in a region in which the leading end part extending between the selvage of the fabric and the weft yarn sucking device moves toward the take-up, the length of the reed does not need to be adjusted or some dents of the reed do not need to be removed to avoid interference between the reed and the weft yarn cutting device. Thus, the leading end parts of the weft yarns projecting from the selvage of the fabric can be cut and disposed of without using any catch cords regardless of the type of the reed on the shuttleless loom. The supplementary nozzle disposed opposite to the first suction opening of the weft yarn sucking device enhances the reliability of the weft yarn end sucking operation of the weft yarn sucking device.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A method of removing a leading end part of a picked weft yarn on a shuttleless loom capable of holding the leading end part of the picked weft yarn under tension by a weft yarn tightening device disposed on an arriving side opposite a picking side and of beating up the tight picked weft yarn into a cloth fell of a fabric by a reed, and having a weft yarn sucking device disposed at a position nearer to a take-up with respect to the cloth fell to hold the leading end part of the weft yarn picked and beaten up into the cloth fell and a weft yarn cutting device disposed at a position nearer to the take-up with respect to the cloth fell to cut the leading end part of the picked and beaten up weft yarn projecting from a selvage of the fabric on the arriving side in a cutting region between the selvage of the fabric and the weft yarn sucking device, said method comprising:

sucking the leading end part of the picked weft yarn being shifted toward the cloth fell of the fabric by a beat-up motion into the weft yarn sucking device through a first suction opening thereof, lying on a path of the picked weft yarn and extending in a picking direction;

holding the leading end part of the weft yarn beaten up into the cloth fell in a second suction opening of the weft yarn sucking device, continuous with the first suction opening, lying opposite to the selvage of the fabric and opening in a take-up direction; and cutting the leading end part of the weft yarn extending between the selvage of the fabric and the second suction opening off the weft yarn beaten up into the cloth fell by the weft yarn cutting device.

2. A weft yarn end removing mechanism incorporated into a shuttleless loom capable of holding a leading end part of a picked weft yarn under tension and of beating up the tight picked weft yarn into a cloth fell of a fabric by a reed, said weft yarn end removing mechanism comprising:

a weft yarn sucking device disposed at a position nearer to a take-up with respect to a cloth fell of a fabric on the shuttleless loom to hold the leading end part of the weft yarn beaten up into the cloth fell; and a weft yarn cutting device disposed at a position nearer to the take-up with respect to the cloth fell to cut off the leading end part of the weft yarn beaten up into the cloth fell in a cutting region in which the leading end part of the weft yarn is extended between a selvage of the fabric and the weft yarn sucking device;

wherein the weft yarn sucking device has a first suction opening lying opposite to the picked weft yarn and extending in a picking direction to suck the leading end part of the picked weft yarn being shifted toward the cloth fell of the fabric by a beat-up motion therethrough into the weft yarn sucking device, and a second suction opening continuous with the first suction opening, lying opposite to the selvage of the fabric, and opening in a take-up direction to hold the leading end part of the weft yarn beaten up into the cloth fell.

3. The weft yarn end removing mechanism according to claim 2 further comprising an air jetting nozzle disposed opposite to the first suction opening of the weft yarn sucking device to jet air toward the first suction opening of the weft yarn sucking device.

* * * * *